US008540328B2

(12) United States Patent
Chen et al.

(10) Patent No.: US 8,540,328 B2
(45) Date of Patent: Sep. 24, 2013

(54) CONTROL MECHANISM FOR DRAWER SLIDE ASSEMBLY

(75) Inventors: Ken-Ching Chen, Kaohsiung Hsien (TW); Yi-Syuan Jhao, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 136 days.

(21) Appl. No.: 12/984,754

(22) Filed: Jan. 5, 2011

(65) Prior Publication Data

US 2012/0169199 A1 Jul. 5, 2012

(51) Int. Cl.
*A47B 95/00* (2006.01)

(52) U.S. Cl.
USPC ..... 312/333

(58) Field of Classification Search
USPC ..... 312/330.1, 333, 334.1, 334.7, 334.8, 312/334.11, 334.44, 334.46; 384/18, 20, 384/21, 22
See application file for complete search history.

(56) References Cited

U.S. PATENT DOCUMENTS 2,485,799 A * 10/1949 Woytych ..... 279/76
4,228,745 A * 10/1980 Gale ..... 108/116
4,573,824 A * 3/1986 Ehle ..... 403/322.1
5,181,782 A * 1/1993 Wojcik ..... 384/21
5,288,182 A * 2/1994 Patterson et al. ..... 408/146
5,356,207 A * 10/1994 Rock et al. ..... 312/334.46
6,460,954 B1 * 10/2002 Bayani et al. ..... 312/334.44
6,543,318 B1 * 4/2003 Erickson ..... 82/1.11
6,883,884 B2 * 4/2005 Chen et al. ..... 312/333
7,001,004 B2 * 2/2006 Bartloff et al. ..... 312/334.45
7,458,651 B1 * 12/2008 Radke et al. ..... 312/333
2004/0123749 A1 * 7/2004 Roebuck ..... 101/41
2008/0303399 A1 * 12/2008 Huang et al. ..... 312/334.46

FOREIGN PATENT DOCUMENTS

WO WO08-055876 * 5/2008

* cited by examiner

*Primary Examiner* — Darnell Jayne
*Assistant Examiner* — Matthew Ing
(74) *Attorney, Agent, or Firm* — Rosenberg, Klein & Lee

(57) ABSTRACT

A control mechanism for a drawer slide assembly which includes a first slide member and a second slide member. The control mechanism includes an adjustment member and a pair of stop members. The adjustment member is rotationally connected to the second slide member, and the pair of stop members are connected to the adjustment member and each have a stop portion located corresponding to the first slide member. The first slide member includes a catch portion which is located corresponding to one of the stop portions. The pair of the stop members are moved by rotation of the adjustment member. When the second slide member is retracted relative to the first slide member, the first and second stop portions are respectively adjusted and are engaged with the catch portion of the first side member to position the second slide member.

6 Claims, 5 Drawing Sheets

CONTROL MECHANISM FOR DRAWER SLIDE ASSEMBLY

FIELD OF THE INVENTION

The present invention relates to a control mechanism for a drawer slide assembly, and more particularly, to a control mechanism for keeping the drawer slide being secured when the drawer slide is in retracted position and for preventing the drawer slide from opening unexpectedly.

BACKGROUND OF THE INVENTION

U.S. Pat. No. 7,458,651 to Radke et al. discloses a "Drawer slide with adjustable strike" and includes a strike mechanism 18 adjustably connected to an inner slide member and the strike mechanism includes a strike body 20 and a C-shaped strike arm 22 connected to the strike body. A catch 38 is positioned at an end of the passage of the outer slide member, wherein the C-shaped arm protrudes beyond the periphery of the passage of the inner slide member. The catch includes a protrusion which is located at the passage of the outer slide member so as to be engaged with the C-shaped arm.

The disclosure of Radke et al. uses a screw driver to adjust the strike level of the C-shaped arm and the protrusion of the catch to make the C-shaped arm strikes the protrusion of the catch when the inner slide member is retracted relative to the outer slide member, and the C-shaped arm is deformed and extends beyond the protrusion of the catch and contacts the protrusion of the catch.

However, the invention of Radke et al. has to use the screw driver for adjustment and this is not convenient for the users. Besides, the C-shaped arm is struck at the same position and this accelerates the C-shaped arm to reach its critical point and reduces the life of use.

SUMMARY OF THE INVENTION

The present invention intends to provide a control mechanism for a drawer slide assembly without using any tool, and the strike force can be dispersed to increase the life of use.

The present invention provides a control mechanism for a drawer slide assembly and improves the shortcomings of the conventional slide assembly.

The present invention relates to a control mechanism for a drawer slide assembly, and the slide assembly comprises a first slide member which has a first side and a second side which is located at a distance from the first side. The first side and the second side each have a catch portion. A second slide member is longitudinally and slidably located relative to the first slide member. The second slide member has a first side and a second side which is located at a distance from the first side of the second slide member. The control mechanism comprises a frame fixed to the drawer slide assembly; an adjustment member movably connected to the frame and including a first threaded rod, a second threaded rod located corresponding to the first threaded rod, and an adjustment portion connected to the first and second threaded rods; a first stop member threadedly connected to the first threaded rod of the adjustment member and having a first stop portion; and a second stop member threadedly connected to the second threaded rod of the adjustment member and having a second stop portion; wherein the first and second stop members are moved by rotation of the adjustment member.

Preferably, the first stop member has a first threaded hole and the second stop member has a second threaded hole.

Preferably, the first stop portion has a first protrusion and the first protrusion has a first contact surface, a first guide surface and a first top which is located between the first contact surface and the first guide surface.

Preferably, the second stop portion has a second protrusion and the second protrusion has a second contact surface, a second guide surface and a second top which is located between the second contact surface and the second guide surface.

Preferably, the first stop portion has a first protrusion and the first protrusion has a hollow interior which is shaped correspondingly to an outer contour of the first protrusion.

Preferably, the second stop portion has a second protrusion and the second protrusion has a hollow interior which is shaped correspondingly to an outer contour of the second protrusion.

The primary object of the present invention is to provide a control mechanism for a drawer slide assembly without using any tool, and the strike force can be dispersed to increase the life of use.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
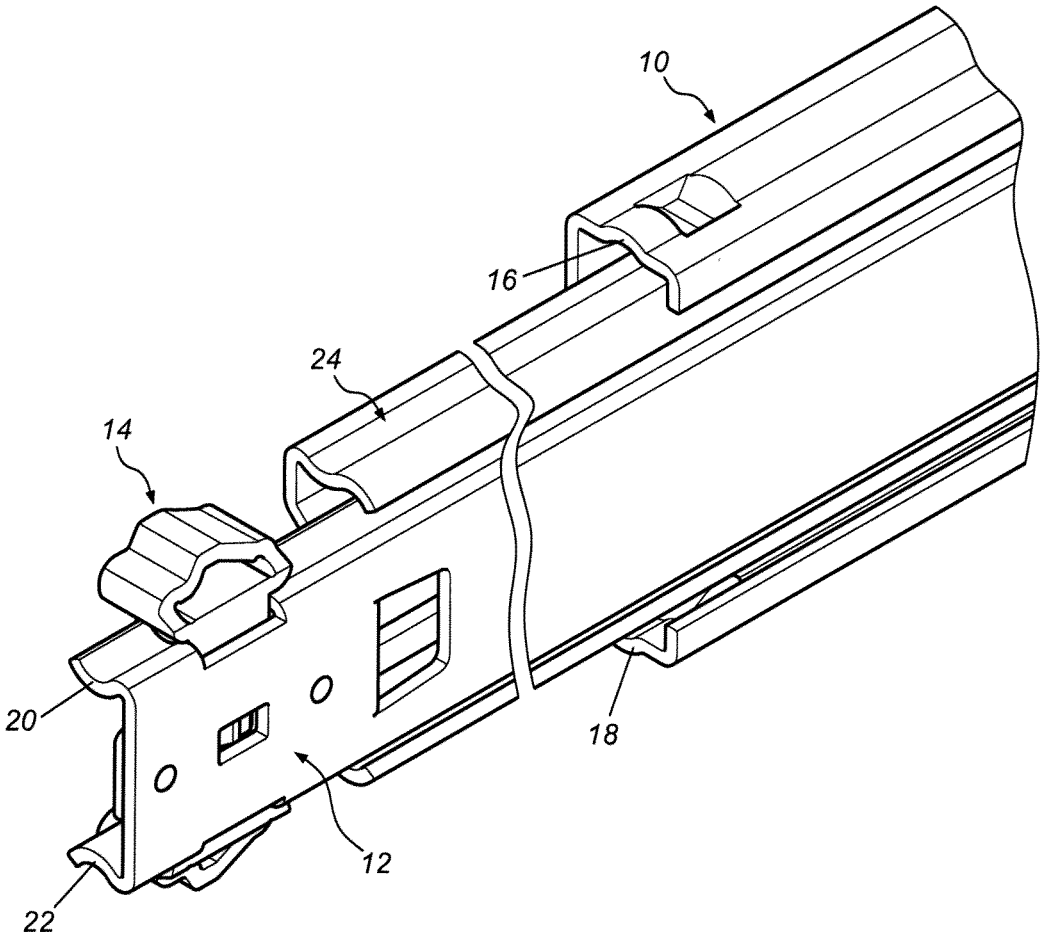
FIG. 1 is a perspective view to show the control mechanism in an embodiment of the present invention connected to a drawer slide assembly.

Referring to FIG. 1, the drawer slide assembly comprises a first slide member 10 and a second slide member 12 which is longitudinally and slidably located relative to the first slide member 10, and a control mechanism 14. The first slide member 10 has a first side 16 and a second side 18 which is located at a distance from the first side 16. The second slide member 12 has a first side 20 and a second side 22 which is located at a distance from the first side 20 of the second slide member 12. In a preferable embodiment, a third slide member 24 is longitudinally and slidably connected between the first and second slide members 10, 12 so that the second slide member 12 is pulled longer relative to the first slide member 10 by the third slide member 24.

Figure 2:
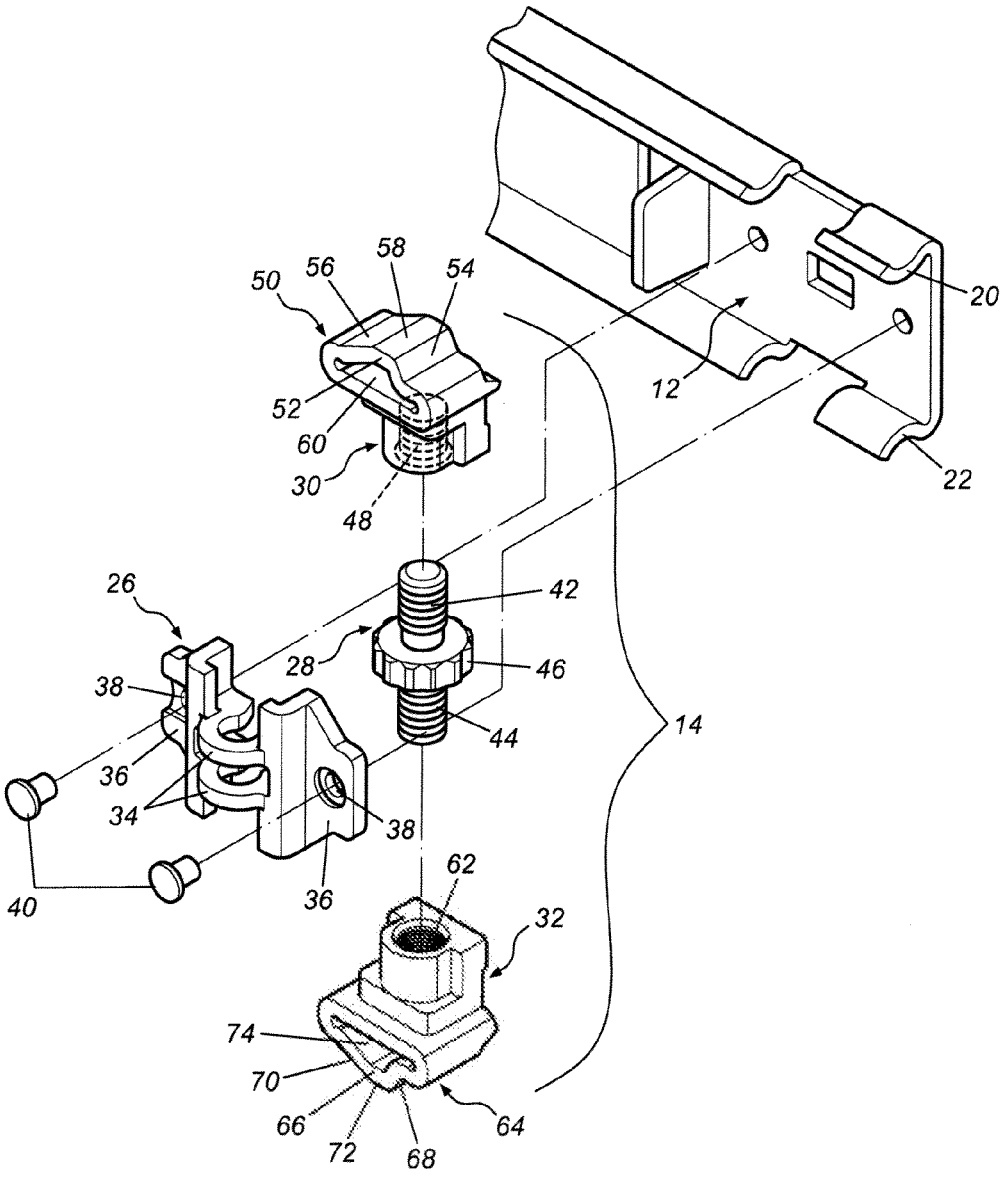
FIG. 2 is an exploded view to show the control mechanism in the embodiment of the present invention.
Figure 3:
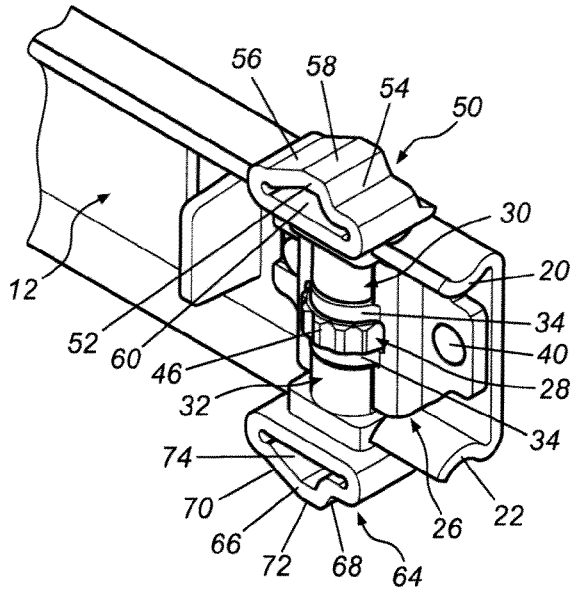
FIG. 3 is a perspective view to show the control mechanism in the embodiment of the present invention.

FIGS. 2 and 3 show a preferable embodiment of the control mechanism 14 of the present invention. The control mechanism 14 comprises a frame 26, an adjustment member 28, a first stop member 30 and a second stop member 32.

The frame 26 includes two separated and curved ribs 34 which are connected between two wings 36, and each wing 36 has a through hole 38 defined therethrough. Fasteners 40, such as rivets, extend through the two through holes 38 to fix the frame 26 to the front end of the second slide member 12.

The adjustment member 28 is movably connected to the frame 26 and includes a first threaded rod 42, a second threaded rod 44 located corresponding to the first threaded rod 42, and an adjustment portion 46 connected to the first and second threaded rods 42, 44. As shown in FIG. 3, the adjustment member 28 is movably connected to the frame 26 and the adjustment portion 46 is exposed between the two ribs 34 of the frame 26 so that the user can directly switch the adjustment portion 46 to rotate the adjustment member 28.

The first stop member 30 includes a first threaded hole 48 to which the first threaded rod 42 of the adjustment member 28 is threadedly connected. The first stop member 30 is substantially perpendicular to the first side 20 of the second slide member 12. The first stop member 30 further includes a first stop portion 50 which is located corresponding to the first side 20 of the second slide member 12. Furthermore, the first stop portion 50 has a first protrusion 52. The first protrusion 52 has a first contact surface 54, a first guide surface 56 and a first top 58 which is located between the first contact surface 54 and the first guide surface 56. If the first protrusion 52 is a solid member (not shown), a resilient member is preferable, such as rubber. Alternatively, the first stop portion 50 has the first protrusion 52 and the first protrusion 52 has a hollow interior 60 which is shaped correspondingly to an outer contour of the first protrusion 52, so that the first protrusion 52 can be deformed in the hollow interior 60. The hollow structure allows the first protrusion 52 to be made by harder resilient material such as plastic, and the first protrusion 52 and the first stop member 30 can be a one-piece member. The resilient material is not restricted the material mentioned above, other resilient material is included in the resilient material mentioned above.

The second stop member 32 is arranged similar to that of the first stop member 30 and includes a second threaded hole 62 to which the second threaded rod 44 of the adjustment member 28 is threadedly connected. The second stop member 32 is substantially perpendicular to the second side 22 of the second slide member 12. The second stop portion 64 has a second protrusion 66. The second protrusion 66 has a second contact surface 68, a second guide surface 70 and a second top 72 which is located between the second contact surface 68 and the second guide surface 70. As the arrangement of the first stop member 30, in the disclosed embodiment, the second protrusion 66 has a hollow interior 74 which is shaped correspondingly to an outer contour of the second protrusion 66, so that the second protrusion 66 can be deformed in the hollow interior 74.

Figure 4:
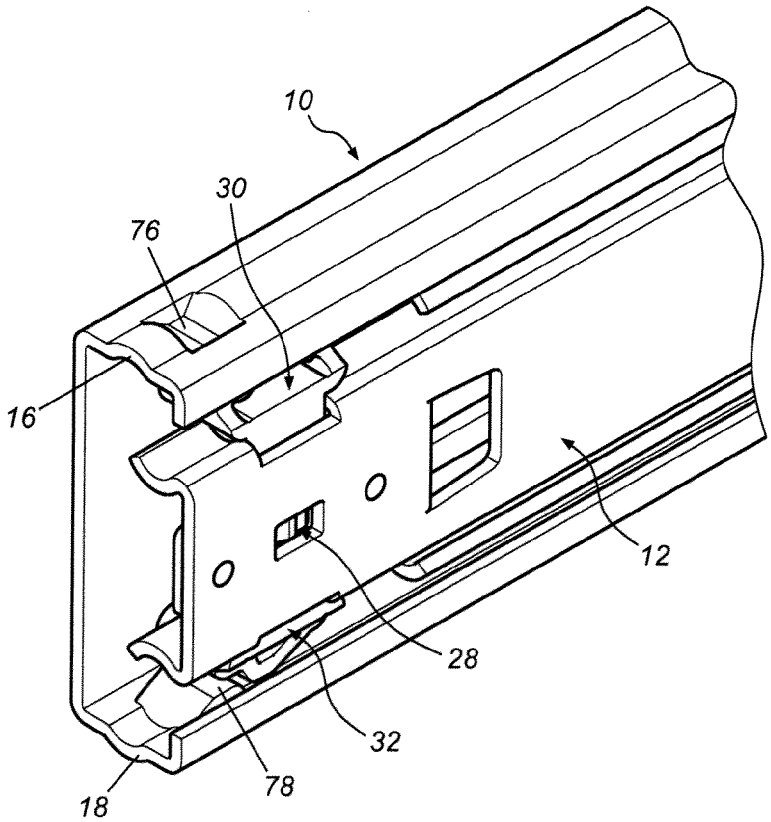
FIG. 4 is a perspective view to show the control mechanism in the embodiment of the present invention used to a drawer slide assembly.

As shown in FIG. 4, the first side 16 and the second side 18 of the first slide member 10 each have a catch portion 76, 78. When the second slide member 12 is retracted relative to the first slide member 10, the first and second stop members 30, 32 are respectively located corresponding to the catch portions 76, 78 of the first and second sides 16, 18 of the first slide member 10.

Figure 5:
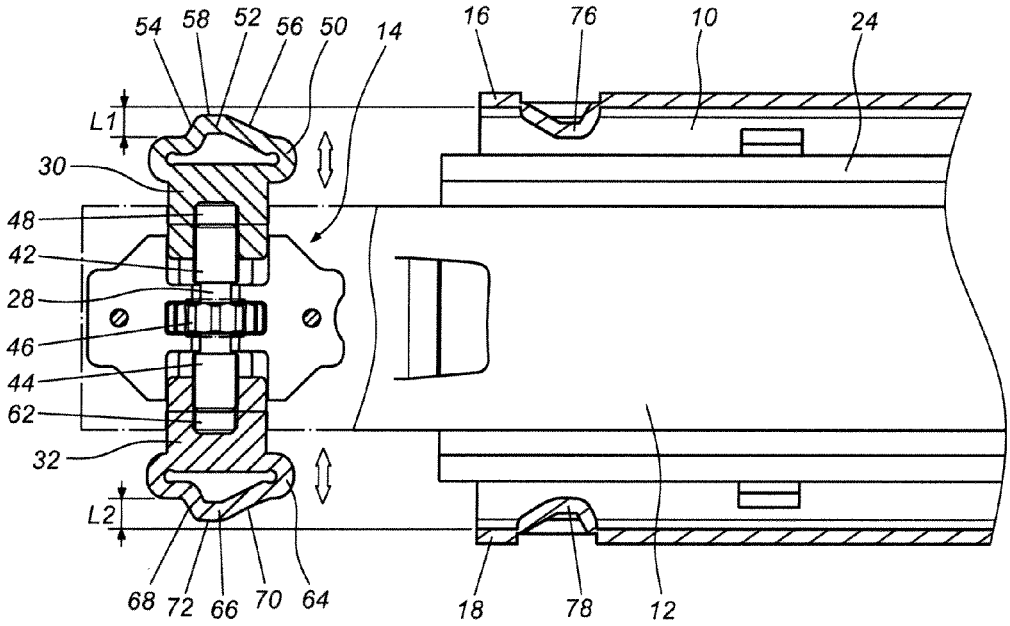
FIG. 5 is a partial cross sectional view to show that the control mechanism in the embodiment of the present invention used to the drawer slide assembly.

As shown in FIG. 5, when adjusting the control mechanism 14, the second slide member 12 is pulled out relative to the first slide member 10 to expose the control mechanism 14. When the adjustment portion 46 of the adjustment member 28 is turned, the first and second threaded rods 42, 44 are respectively rotated in the first and second threaded holes 48, 62 of the first and second stop members 30, 32 so that the first and second stop portions 50, 64 are together moved to change the straight distances L1 and L2 between the first and second sides 16, 18 of the first slide member 10. Therefore, the force that the first and second stop portions 50, 64 are engaged with the catch portions 76, 78 of the first and second sides 16, 18 of the first slide member 10 is controlled, wherein the smaller the distances of the L1, L2, the larger the force of the contact between the first and second stop portions 50, 64 and the catch portions 76, 78.

Figure 6:
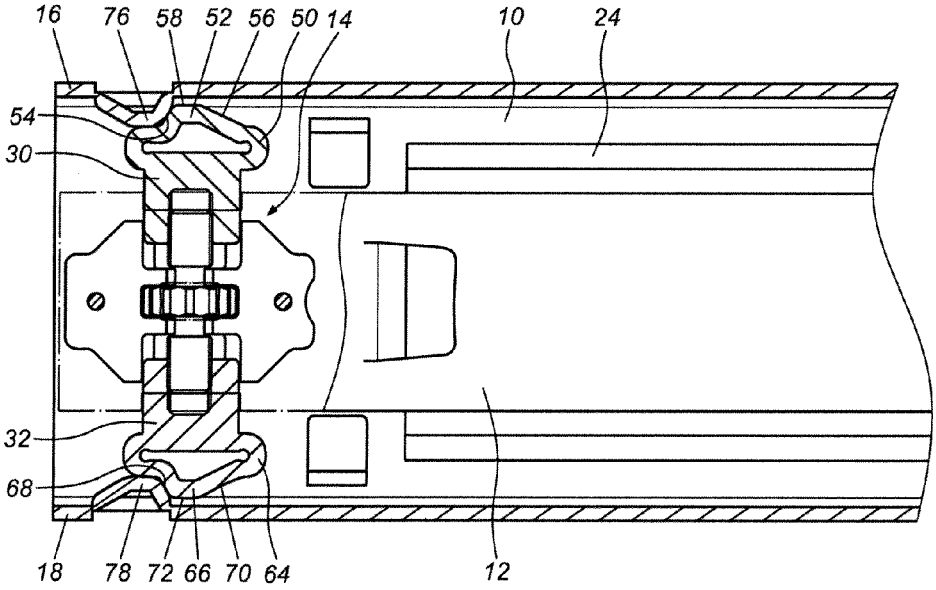
FIG. 6 is a partial cross sectional view to show that the control mechanism in the embodiment of the present invention used to the drawer slide assembly, and the control mechanism is in positioned position.

When the distances L1, L2 of the first and second stop portions 50, 64 of the first and second stop members 30, 32 relative to the first and second sides 16, 18 of the first slide member 10 are adjusted, as shown in FIG. 6, the second and third slide members 12, 24 are retracted to the first slide member 10. The first protrusion 52 of the first stop portion 50 and the second protrusion 66 of the second stop portion 64 are engaged with the two catch portions 76, 78 of the first and second sides 16, 18 of the first slide member 10. In detail, the first contact surface 54 of the first protrusion 52 contacts the catch portion 76 of the first side 16 of the first slide member 10, and the second contact surface 68 of the second protrusion 66 contacts the catch portion 78 of the second side 18 of the first slide member 10 to obtain the relative secured positioning feature.

While we have shown and described the embodiment in accordance with the present invention, it should be clear to those skilled in the art that further embodiments may be made without departing from the scope of the present invention.

What is claimed is:

1. A control mechanism for use with a drawer slide assembly, comprising:

a drawer slide assembly including telescopically coupled first and second slide members;

a frame fixed to a lateral face of the second slide member of the drawer slide assembly, the frame including a pair of spaced end portions and a plurality of ribs coupled to bridge the space therebetween;

an adjustment member rotatably connected to the frame and including a first threaded rod, a second threaded rod located corresponding to the first threaded rod, and an adjustment portion disposed intermediate the first and second threaded rods and being respectively connected thereto for rotation of the first and second threaded rods therewith, the adjustment portion protruding from the frame between an adjacent pair of the ribs to longitudinally secure the adjustment member to the frame and remain toollessly rotatable by a user;

a first stop member having a first threaded hole threadedly connected to the first threaded rod of the adjustment member and having a first stop portion; and a second stop member having a second threaded hole threadedly connected to the second threaded rod of the adjustment member and having a second stop portion;

wherein the first and second stop members are simultaneously moved by rotation of the adjustment portion, the adjustment member maintaining the first and second stop members to resiliently engage a pair of longitudinally opposed catch portions formed on the drawer assembly to releasably lock the slide members one relative to the other.

2. The control mechanism as claimed in claim 1, wherein the first stop portion has a first protrusion and the first protrusion has a first contact surface, a first guide surface and a first top which is located between the first contact surface and the first guide surface.

3. The control mechanism as claimed in claim 1, wherein the second stop portion has a second protrusion and the second protrusion has a second contact surface, a second guide surface and a second top which is located between the second contact surface and the second guide surface.

4. The control mechanism as claimed in claim 1, wherein the first stop portion has a first protrusion and the first protrusion has a hollow interior which is shaped correspondingly to an outer contour of the first protrusion.

5. The control mechanism as claimed in claim 1, wherein the second stop portion has a second protrusion and the second protrusion has a hollow interior which is shaped correspondingly to an outer contour of the second protrusion.

6. The control mechanism as claimed in claim 1, wherein the first slide member includes longitudinally opposed first and second side edges, the first and second side edges each having one of the catch portions formed thereon; the second slide member being slidably disposed relative to the first slide member, the second slide member having longitudinally opposed first and second side edges; when the second slide member is retracted relative to the first slide member, the first and second stop portions respectively engaged the respective catch portions of the first and second side edges of the first slide member.

* * * * *